US010304432B2

(12) United States Patent
Tajika

(10) Patent No.: US 10,304,432 B2
(45) Date of Patent: May 28, 2019

(54) ELECTRONIC MUSICAL INSTRUMENT, SOUND PRODUCTION CONTROL METHOD, AND STORAGE MEDIUM

(71) Applicant: CASIO COMPUTER CO., LTD., Tokyo (JP)

(72) Inventor: Yoshinori Tajika, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/913,680

(22) Filed: Mar. 6, 2018

(65) Prior Publication Data

US 2018/0261196 A1 Sep. 13, 2018

(30) Foreign Application Priority Data

Mar. 8, 2017 (JP) ..... 2017-043710

(51) Int. Cl.

| | |
|---|---|
| ***G10H 1/00*** | (2006.01) |
| ***G10H 1/32*** | (2006.01) |
| ***G10H 1/053*** | (2006.01) |
| ***G10H 1/46*** | (2006.01) |
| ***G10H 1/34*** | (2006.01) |

(52) U.S. Cl.

CPC ..... *G10H 1/053* (2013.01); *G10H 1/0008* (2013.01); *G10H 1/0091* (2013.01); *G10H 1/344* (2013.01); *G10H 1/46* (2013.01); *G10H 2210/271* (2013.01); *G10H 2210/305* (2013.01); *G10H 2220/221* (2013.01)

(58) Field of Classification Search

CPC ..... G10H 1/183; G10H 1/344; G10H 1/346; G10K 15/00; G10K 11/20; G10C 3/12; G10G 1/00

See application file for complete search history.

(56) References Cited

U.S. PATENT DOCUMENTS

| | | | | |
|---|---|---|---|---|
| 5,422,430 | A | 6/1995 | Ikeya et al. | |
| 2007/0289435 | A1 | 12/2007 | Tajika | |
| 2015/0221296 | A1* | 8/2015 | Nakata | G10H 1/06 84/725 |

(Continued)

FOREIGN PATENT DOCUMENTS

| | | | |
|---|---|---|---|
| JP | H02-066597 | A | 3/1990 |
| JP | H05-6170 | A | 1/1993 |

(Continued)

OTHER PUBLICATIONS

European Search Report dated May 8, 2018, in a counterpart European patent application No. 18160030.5.

*Primary Examiner* — Marlon T Fletcher

(74) *Attorney, Agent, or Firm* — Chen Yoshimura LLP

(57) ABSTRACT

An electronic musical instrument includes a keyboard, a sound-producing system, and a control unit. A panning value indicating a left-right balance of sound outputted from a left speaker and a right speaker in stereo sound production is assigned to each key of the keyboard such that the left-right balance of soundboard resonant sound waveform data for certain higher-pitch keys is shifted towards the left-speaker as compared with the left-right balance of soundboard resonant sound waveform data for certain lower-pitch keys that are located to the left of the higher-pitch keys so as to produce realistic piano sound mimicking an actual piano.

11 Claims, 6 Drawing Sheets

(56) References Cited

U.S. PATENT DOCUMENTS

| | | | | |
|---|---|---|---|---|
| 2015/0228261 | A1* | 8/2015 | Nakata | G10H 1/06 84/622 |
| 2018/0261196 | A1* | 9/2018 | Tajika | G10H 1/0008 |

FOREIGN PATENT DOCUMENTS

| | | | |
|---|---|---|---|
| JP | H06-202631 | | 7/1994 |
| JP | H08-50479 | | 2/1996 |
| JP | H08-190375 | | 7/1996 |
| JP | H09-325777 | A | 12/1997 |
| JP | 2007-322871 | A | 12/2007 |
| JP | 2013-041292 | A | 2/2013 |

* cited by examiner

ELECTRONIC MUSICAL INSTRUMENT, SOUND PRODUCTION CONTROL METHOD, AND STORAGE MEDIUM

BACKGROUND OF THE INVENTION

Technical Field

The present invention relates to an electronic musical instrument that produces sound in the same manner as an acoustic piano, to a sound production control method, and to a storage medium.

Background Art

Heretofore, various technologies have been developed for reproducing the tone colors of an acoustic piano. For example, Patent Document 1 discloses a technology in which the sound of a piano recorded using four-channel microphones is output from four-channel speakers of an electronic musical instrument in order to realistically reproduce the sound of the piano at the position of the performer.

Patent Document 1: Japanese Patent Application Laid-Open Publication No. 2013-41292

However, it is assumed in the invention disclosed in Patent Document 1 that the electronic musical instrument is equipped with four-channel speakers, and the speakers need to be arranged so as to correspond to the positions of the corresponding microphones. Therefore, there is a problem in that the above-described technology cannot be applied to general electronic musical instruments.

SUMMARY OF THE INVENTION

Accordingly, the present invention is directed to a scheme that substantially obviates one or more of the problems due to limitations and disadvantages of the related art.

According to the present invention, a general electronic musical instrument can be made to produce sound in the same manner as an acoustic piano.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides an electronic musical instrument including: a first key that is assigned a sound of a first pitch; a second key that is arranged to the right of the first key, the second key being assigned a sound of a second pitch that is higher than the first pitch; a third key that is arranged to the right of the second key, the third key being assigned a sound of a third pitch that is higher than the second pitch; and one or more processors that acquire panning values respectively assigned to the first key, the second key, and the third key, each panning value setting forth a left-right balance between a left-channel speaker and a right-channel speaker for the sound specified by each key, and the one or more processors generating, in response to an operation of one of the first, second and third keys, corresponding sound data for outputting from the left-channel speaker and the right-channel speaker in accordance with the assigned panning value, wherein the panning values respectively assigned to the second and third keys are set such that the left-right balance of the sound data of the third key is shifted towards the left speaker as compared with the left-right balance of the sound data of the second key.

In the above-mentioned electronic musical instrument, the sound data of each of the first through third keys may include soundboard resonant sound data that represents sound produced when a soundboard of an acoustic piano resonates, and each of the panning values may set forth the left-right balance for the soundboard resonant sound data so that the left-right balance of the soundboard resonant sound data of the third key is shifted towards the left speaker as compared with the left-right balance of the soundboard resonant sound data of the second key.

The above-mentioned electronic musical instrument may further include a keyboard having a plurality of keys arranged from the left to the right, representing progressively higher pitches from the left to the right, the keyboard including said first, second and third keys, wherein panning values are respectively assigned to all of the plurality of keys, wherein the keyboard includes a first plurality of keys that are arranged consecutively from a key that is at the immediate right to the second key and that includes the third key, and wherein the panning value for each of the first plurality of keys is set such that the left-right balance of the sound data of each of the first plurality of keys is shifted towards the left speaker as compared with the left-right balance of the sound data of the second key. The above-mentioned electronic musical instrument may further include a keyboard having a plurality of keys arranged from the left to the right, representing progressively higher pitches from the left to the right, the keyboard including said first, second and third keys, wherein panning values are respectively assigned to all of the plurality of keys, and wherein the sound data of each of the first through third keys includes soundboard resonant sound data that represents sound produced when a soundboard of an acoustic piano resonates, and wherein each of the panning values sets forth the left-right balance for the soundboard resonant sound data so that the left-right balance of the soundboard resonant sound data of the third key is shifted towards the left speaker as compared with the left-right balance of the soundboard resonant sound data of a leftmost key that is assigned to a lowest pitch sound.

In another aspect, the present disclosure provides a sound production control method performed by one or more processors in an electronic musical instrument that includes: a first key that is assigned a sound of a first pitch; a second key that is arranged to the right of the first key, the second key being assigned a sound of a second pitch that is higher than the first pitch; a third key that is arranged to the right of the second key, the third key being assigned a sound of a third pitch that is higher than the second pitch; and said processor, the method including: acquiring panning values respectively assigned to the first key, the second key, and the third key, each panning value setting forth a left-right balance between a left-channel speaker and a right-channel speaker for the sound specified by each key; and in response to an operation of one of the first, second and third keys, generating corresponding sound data for outputting from the left-channel speaker and the right-channel speaker in accordance with the assigned panning value, wherein the panning values respectively assigned to the second and third keys are set such that the left-right balance of the sound data of the third key is shifted towards the left speaker as compared with the left-right balance of the sound data of the second key.

In another aspect, the present disclosure provides a non-transitory computer-readable storage medium having stored thereon a program executable by one or more processors in an electronic musical instrument that includes: a first key that is assigned a sound of a first pitch; a second key that is arranged to the right of the first key, the second key being assigned a sound of a second pitch that is higher than the first pitch; a third key that is arranged to the right of the second key, the third key being assigned a sound of a third pitch that is higher than the second pitch; and said processor, the program causing the one or more processors to perform the following: acquiring panning values respectively assigned to the first key, the second key, and the third key, each panning value setting forth a left-right balance between a left-channel speaker and a right-channel speaker for the sound specified by each key; and in response to an operation of one of the first, second and third keys, generating corresponding sound data for outputting from the left-channel speaker and the right-channel speaker in accordance with the assigned panning value, wherein the panning values respectively assigned to the second and third keys are set such that the left-right balance of the sound data of the third key is shifted towards the left speaker as compared with the left-right balance of the sound data of the second key.

It is to be understood that both the foregoing general description and the following detailed description are exemplary and explanatory, and are intended to provide further explanation of the invention as claimed.

BRIEF DESCRIPTION OF THE DRAWINGS

The present application can be better understood by considering the following detailed description together with the accompanying drawings.

DETAILED DESCRIPTION OF EMBODIMENTS

Figure 1:
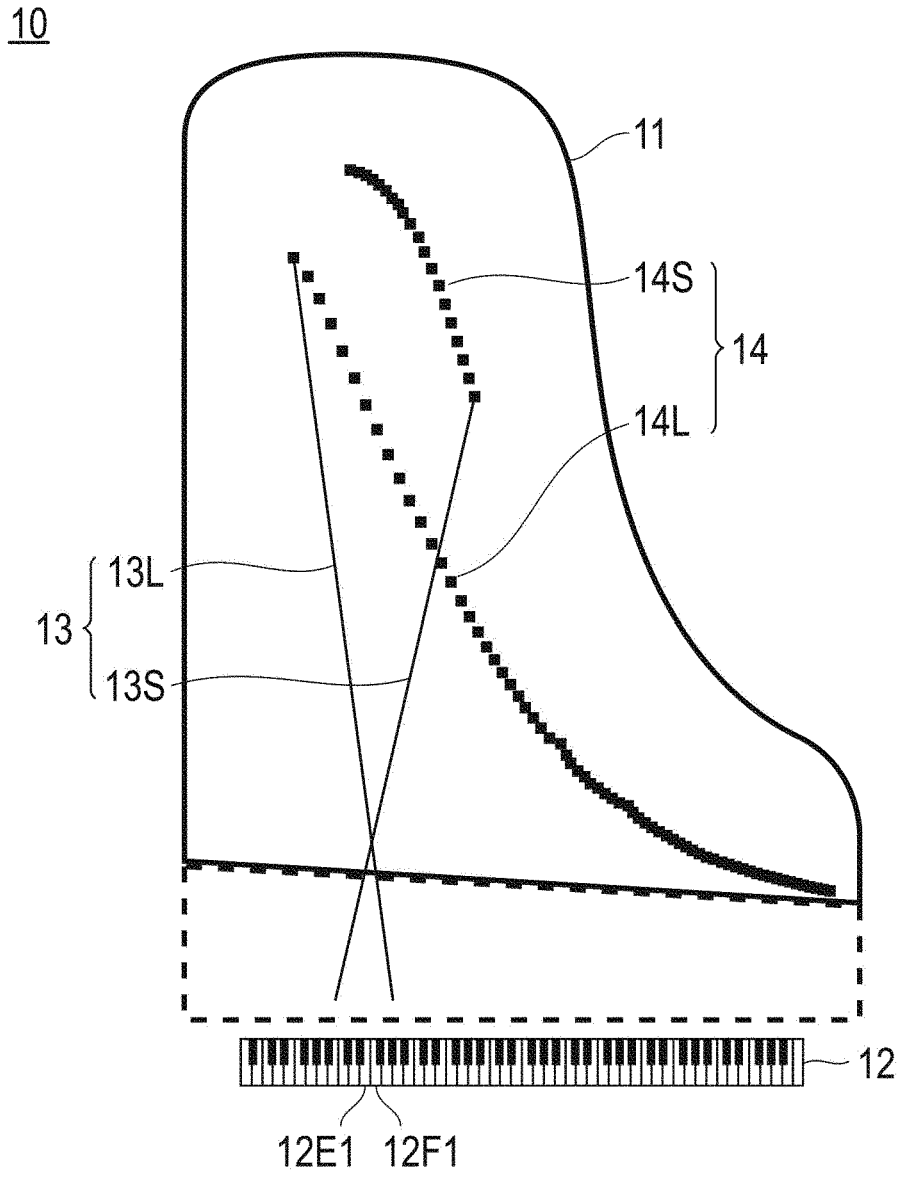
FIG. 1 is a plan view illustrating an example of the basic configuration of an acoustic piano (grand piano).

Hereafter, the principles of the present invention and a method of generating musical sound waveform data used in the present invention are described while referring to the drawings. After that, an embodiment based on the principles of the present invention will be described. The dimensional ratios in the drawings are exaggerated for convenience of explanation and may be different from the actual ratios.

<Principles of Invention>

FIG. 1 is a plan view illustrating an example of the basic configuration of an acoustic piano (grand piano).

An acoustic piano 10 includes a soundboard 11, a keyboard 12, a plurality of strings 13, and a plurality of bridges 14. The soundboard 11 is a wooden vibrating board that has the shape represented by the solid line in FIG. 1, and resonates upon receiving vibrations of the strings 13. The keyboard 12 includes a plurality of keys. The plurality of strings 13 are a plurality of piano strings that are stretched above the soundboard 11. The plurality of bridges 14 are categorized into a short bridge 14S and a long bridge 14L, are positioned on the soundboard 11, and transmit the vibrations of the strings 13 to the soundboard 11.

In the example illustrated in FIG. 1, the short bridge 14S includes a plurality of bridges that correspond to pitches lower than or equal to a pitch E1, and the long bridge 14L includes a plurality of bridges that correspond to pitches higher than or equal to a pitch F1. A bridge at the right end of the short bridge 14S is a bridge that corresponds to the pitch E1, and the bridge at the left end of the long bridge 14L is a bridge that corresponds to the pitch F1. In other words, bridges ranging from the bridge at left end of the short bridge 14S to the bridge at the right end of the short bridge 14S sequentially correspond to keys ranging from the key at the left end of the keyboard 12 to a key 12E1 of the keyboard 12 corresponding to the pitch E1. Similarly, bridges ranging from the bridge at the left end of the long bridge 14L to the bridge at the right end of the long bridge 14L sequentially correspond to keys ranging from a key 12F1 of the keyboard 12 corresponding to the pitch F1 to the key at the right end of the keyboard 12. The corresponding pairs of bridges and keys are connected to each other by the strings 13. In FIG. 1, only strings 13S and 13L, which respectively correspond to the pitches E1 and F1, are illustrated, and illustration of the rest of the strings is omitted.

When the acoustic piano 10 is operated, first, a certain key that is included in the keyboard 12 is pressed and a hammer (not illustrated), which is located in a region indicated by the broken line in FIG. 1, hits the string 13 that corresponds to the certain key. The vibration generated when the string 13 is hit propagates along the hit string 13, and is transmitted to the soundboard 11 via the short bridge 14S or the long bridge 14L. Then, the soundboard 11 generates a soundboard resonant sound that is centered on the position of the certain bridge 14 that transmits the vibration of the string.

In this way, when a key is pressed, a sound that is produced when the soundboard 11 resonates (hereafter, "soundboard resonant sound") is generated along with the sound that is produced when the string is hit (hereafter, "hit string sound"). In addition, when the key is pressed, the sound of the key striking a keybed (not illustrated) (hereafter "struck keybed sound") of the acoustic piano 10 is also produced. In other words, the sound produced by the acoustic piano 10 includes the hit string sound, the soundboard resonant sound, and the struck keybed sound.

The hit string sound, the soundboard resonant sound, and the struck keybed sound are produced at different positions from one another. For example, the hit string sound is produced at the position where the string is hit by the hammer. Therefore, the position at which the hit string sound is produced moves to the right from the viewpoint of the performer as the pitch of the pressed key becomes higher. In addition, the struck keybed sound is produced at the position where the key is pressed. Therefore, the position at which the struck keybed sound is produced also moves to the right from the viewpoint of the performer as the pitch of the pressed key becomes higher.

On the other hand, the soundboard resonant sound is produced so as to be centered on the position of the bridge 14 that transmits the string vibration. Therefore, in a sound range where the pitch of the pressed key is less than or equal to E1, the position at which the soundboard resonant sound is produced moves from the back left to the front right along the short bridge 14S from the viewpoint of the performer as the pitch becomes higher. In addition, in the sound range where the pitch is higher than or equal to F1, the position at which the soundboard resonant sound is produced moves from the back left toward the front right along the long bridge 14L from the viewpoint of the performer as the pitch becomes higher. Furthermore, despite the fact that the positions of the keys that correspond to the pitches E1 and F1 are adjacent to each other, the positions of the corresponding bridges are significantly spaced apart from each, and therefore the soundboard resonant sounds are produced at very different positions for the pitches E1 and F1.

According to the present invention, an electronic musical instrument can be made to produce sound in the same manner as an acoustic piano by simulating changes that occur in the positions where a hit string sound, a soundboard resonant sound, and a struck keybed sound, which are included in the sound produced by an acoustic piano, are produced as described above.

<Method of Generating Musical Sound Waveform Data>

In order to simulate changes in the positions where hit string sounds, soundboard resonant sounds, and struck keybed sounds are produced, first, it is necessary to prepare three sets of waveform data for the hit string sounds, the soundboard resonant sounds, and the struck keybed sounds as piano musical sound waveform data. Hereafter, an example of a method of generating the waveform data will be described.

(A) Hit String Sound Waveform Data and Soundboard Resonant Sound Waveform Data

First, the sound that is produced when a key of an acoustic piano is pressed is recorded using a microphone for each pitch. The keys may be pressed in such a manner as to not strike the keybed so that each recorded musical sound contains only the hit string sound and the soundboard resonant sound. Waveform data that represents the hit string sound and the soundboard resonant sound is then generated from the recorded musical sound as described below.

Figure 2A:
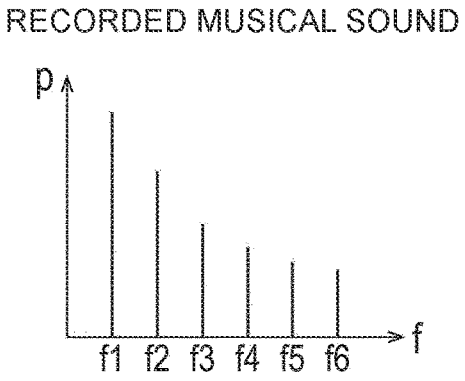
FIGS. 2A, 2B and 2C are diagrams for explaining an example of a method of generating waveform data of a hit string sound (FIG. 2B) and a soundboard resonant sound (FIG. 2C) from recorded musical sound.
Figure 2B:
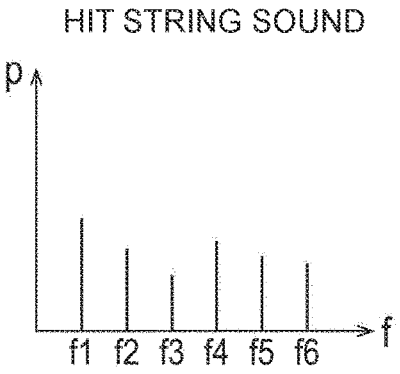
Figure 2C:
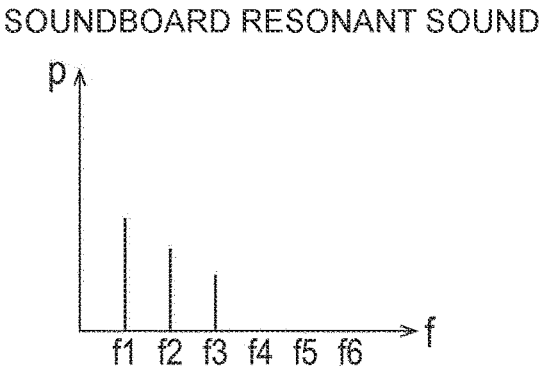

FIGS. 2A, 2B and 2C are diagrams for explaining an example of a method of generating the waveform data of a hit string sound (FIG. 2B) and a soundboard resonant sound (FIG. 2C) from recorded musical sound.

FIG. 2A illustrates an example of frequency components contained in a recorded musical sound. FIG. 2B illustrates an example of frequency components contained in hit string sound waveform data produced from FIG. 2A. FIG. 2C illustrates an example of frequency components contained in soundboard resonant sound waveform data produced from FIG. 2A.

As illustrated in FIG. 2A, it is assumed that the recorded musical sound includes a fundamental tone component at a frequency f1 and second to sixth harmonics components at frequencies f2 to f6, the respective components having different amplitudes p. For example, as illustrated in FIG. 2B, hit string sound waveform data can be generated on the basis of the recorded musical sound so as to include the components at frequencies f1 to f3 with half the amplitudes that the components have in FIG. 2A and so as to include the components at frequencies f4 to f6 with the same amplitudes as in FIG. 2A. In addition, for example, as illustrated in FIG. 2 C, soundboard resonant sound waveform data can be produced so as to include the components at frequencies f1 to f3 with half the amplitudes that the components have in FIG. 2A and so as not to include the frequency components from f4 and the above. The hit string sound waveform data, which includes many high frequency components, can reproduce the impact sound that is generated when a string is hit, and the soundboard resonant sound waveform data, which contains hardly any high frequency components, can reproduce the resonant sound characteristics of a wooden soundboard that amplifies low-frequency components (low sounds) and attenuates high frequency components (high sounds).

However, the method of generating hit string sound waveform data and soundboard resonant sound waveform data is not limited to the example illustrated in FIGS. 2A to 2C, and the method may be changed as desired in accordance with the acoustic characteristics of the acoustic piano that is to be reproduced. For example, the hit string sound waveform data may include the components at frequencies f1 to f3 with 60% of the amplitudes that the components have in FIG. 2A A, and the soundboard resonant sound waveform data may include the components at frequencies f1 to f3 with 40% of the amplitudes that the components have in FIG. 2A A. The soundboard resonant sound waveform data may alternatively be generated so as to include the fourth or higher harmonics components.

The hit string sound waveform data and the soundboard resonant sound waveform data may be obtained using other methods. For example, a soundboard resonant sound may be produced by making a string vibrate using a method other than hitting the string, and the soundboard resonant sound may then be recorded and obtained as waveform data.

(B) Struck Keybed Sound

The struck keybed sound is a secondary noise component sound that is produced when a key strikes the keybed, and can be recorded separately from the hit string sound and the soundboard resonant sound. For example, struck keybed sound waveform data can be obtained by causing a struck keybed sound to be produced by causing a key to strike the keybed, in a state where the vibration of the string of the acoustic piano that is to be reproduced has been stopped, and recording the struck keybed sound. Since the struck keybed sounds are substantially identical regardless of the pitch of the key that is pressed, the struck keybed sound waveform data obtained for a certain pitch may be used as the struck keybed sound waveform data for all the pitches.

In the example described above, it is described that the struck keybed sound is recorded separately from the hit string sound and the soundboard resonant sound. However, this embodiment is not limited to this method, and the struck keybed sound may instead be recorded together with the hit string sound and the soundboard resonant sound. In this case, a hit string sound and a soundboard resonant sound may be produced after separating out noise components, which are other than the fundamental tone component and the harmonics components, included in the recorded musical sound as a struck keybed sound frequency component.

<Embodiment>

(1) Configuration

Figure 3:
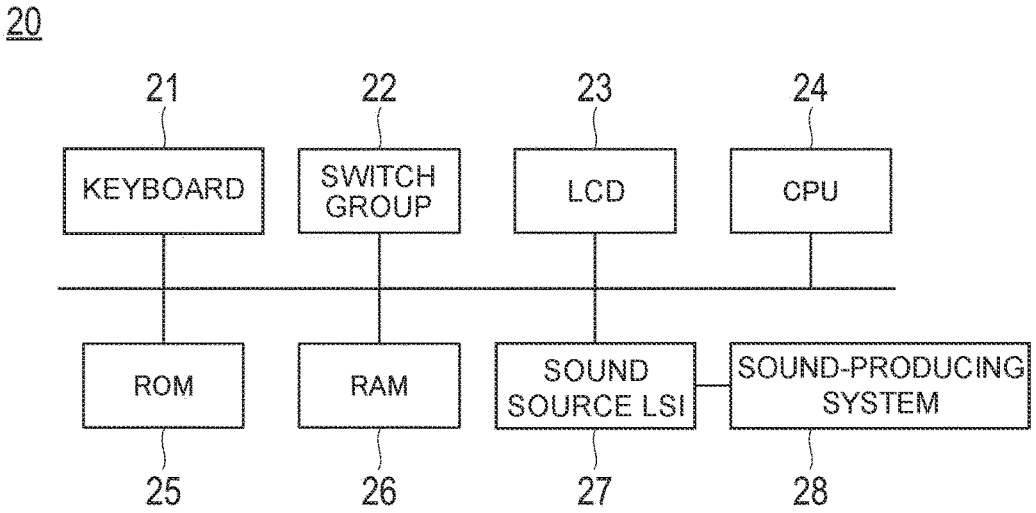
FIG. 3 is a block diagram illustrating the basic configuration of an electronic musical instrument according to an embodiment of the present invention.

FIG. 3 is a block diagram illustrating the basic configuration of an electronic musical instrument according to an embodiment of the present invention.

As illustrated in FIG. 3, an electronic musical instrument 20 includes a keyboard 21, a switch group 22, an LCD 23, a CPU 24, a ROM 25, a RAM 26, a sound source LSI 27, and a sound-producing system 28. These constituent components are connected to each other via a bus.

The keyboard 21 includes a plurality of keys, and generates performance information that includes key on/key off events, note numbers, and velocity values on the basis of key pressing/releasing operations of the individual keys. Hereafter, among the keys of the keyboard 21, one arbitrary key that corresponds to a pitch lower than the pitch E1 (corresponding to note number 40) is referred to as a first key, a key that corresponds to the pitch E1 is referred to as a second key, and a key that corresponds to the pitch F1 (corresponding to note number 41) is referred to as a third key.

The switch group 22 includes various switches such as a power switch, a tone color switch, and so on that are arranged on a panel of the electronic musical instrument 20, and causes switch events to be produced based on switch operations.

The LCD 23 includes an LCD panel and so forth, and displays the setting state, the operation mode and so forth of each part of the electronic musical instrument 20 on the basis of display control signals supplied from the CPU 24, as described later.

The CPU (control unit) 24 executes control of each part of the electronic musical instrument 20, various arithmetic processing operations, and so on in accordance with a program. The CPU 24, for example, generates a note-on command that instructs production of a sound and a note-off command that instructs stopping of producing the sound on the basis of performance information supplied from the keyboard 21, and transmits the commands to the sound source LSI 27, which will be described later. In addition, the CPU 24, for example, controls the operation state of each part of the electronic musical instrument 20 on the basis of switch events supplied from the switch group 22. The processing performed by the CPU 24 will be described in detail later.

The ROM 25 includes a program area and a data area, and stores various programs, various data, and so on. For example, a CPU control program is stored in the program area of the ROM 25, and a panning table, which is described later, will be stored in the data area of the ROM 25.

The RAM 26 functions as a work area and temporarily stores various data, various registers and so on.

The sound source LSI 27 employs a known waveform memory read out system, and stores musical sound waveform data in a waveform memory thereinside and executes various arithmetic processing operations. The sound source LSI 27 stores preprepared hit string sound waveform data, soundboard resonant sound waveform data, and struck keybed sound waveform data as piano musical sound waveform data. Furthermore, the sound source LSI 27 sets panning values in the hit string sound waveform data, the soundboard resonant sound waveform data, and the struck keybed sound waveform data on the basis of the panning Table stored in the ROM 25, and outputs a digital musical sound signal based on the respective waveform data. The panning and the processing performed by the sound source LSI 27 will be described in detail later.

The sound-producing system 28 includes an audio circuit and speakers, and is controlled by the CPU 24 so as to output sound. Using the audio circuit, the sound-producing system 28 converts the digital musical sound signal into an analog musical sound signal, performs filtering and so on to remove unwanted noise, and performs level amplification. In addition, the sound-producing system 28 outputs musical sound based on the analog musical sound signal from the left-channel side and the right-channel side using stereo-output speakers.

<Panning>

"Panning" refers to changing the sound image localization of output sound in the left and right directions by changing the ratio with which sound is output from a left-channel side and a right-channel side in a system equipped with stereo output. Panning values are held in a panning Table in order to implement panning, and have values in the range of 0 to 127, for example. In this embodiment, the sound source LSI 27 sets panning values in the waveform data, and the sound-producing system 28 outputs sound from the left-channel side and the right-channel side in accordance with the panning values.

The sound source LSI 27, for example, makes the proportion of sound output from the left-channel side large by setting the panning value so as to be small, and makes the proportion of sound output from the right-channel side large by setting the panning value so as to large. In other words, the sound source LSI 27 can make sound be output from only the left-channel side by setting the panning value to 0, can make sound be output from only the right-channel side by setting the panning value to 127, and can make sound be equally output from the left- and right-channel sides by setting the panning value to 64. The method of setting the panning value is not limited to the above-described example. That is, the sound source LSI 27 may alternatively make sound be output from only the left-channel side by setting the panning value to 127, and may make sound be output from only the right-channel side by setting the panning value to 0. In addition, other arbitrary values may be used. A point of the present invention concerns where sounds are heard as being made. For example, one merit of some aspects of the present invention is that a feeling is realized that a lowest-pitch sound is heard as being made on the left side when a lowest-pitch key is specified and a highest-pitch sound is heard as being made on the right side when a highest-pitch key is specified, but the system is configured such that a sound that is produced when a third pitch is specified, which is adjacent to and higher than the second pitch, can be manufactured to be heard as being made further toward the left side than the sound that is heard when the second pitch is specified if that effect would more realistically simulate the actual piano sound. In some aspects of the present invention, the system may be configured such that, when a certain number of keys that are higher than a third pitch are specified, it feels as though the sounds are produced further to the left than the sound that is heard when the second pitch is specified.

As described above, in an acoustic piano, a hit string sound, a soundboard resonant sound, and a struck keybed sound are made at different positions from each other. Accordingly, the sound source LSI 27 in this embodiment individually and separately performs panning for the hit string sound waveform data, the soundboard resonant sound waveform data, and the struck keybed sound waveform data, respectively, and realizes, in the electronic musical instrument 20, sound image localization that approximates the positions at which hit string sounds, soundboard resonant sounds, and struck keybed sounds are produced in a real acoustic piano.

Figure 4:
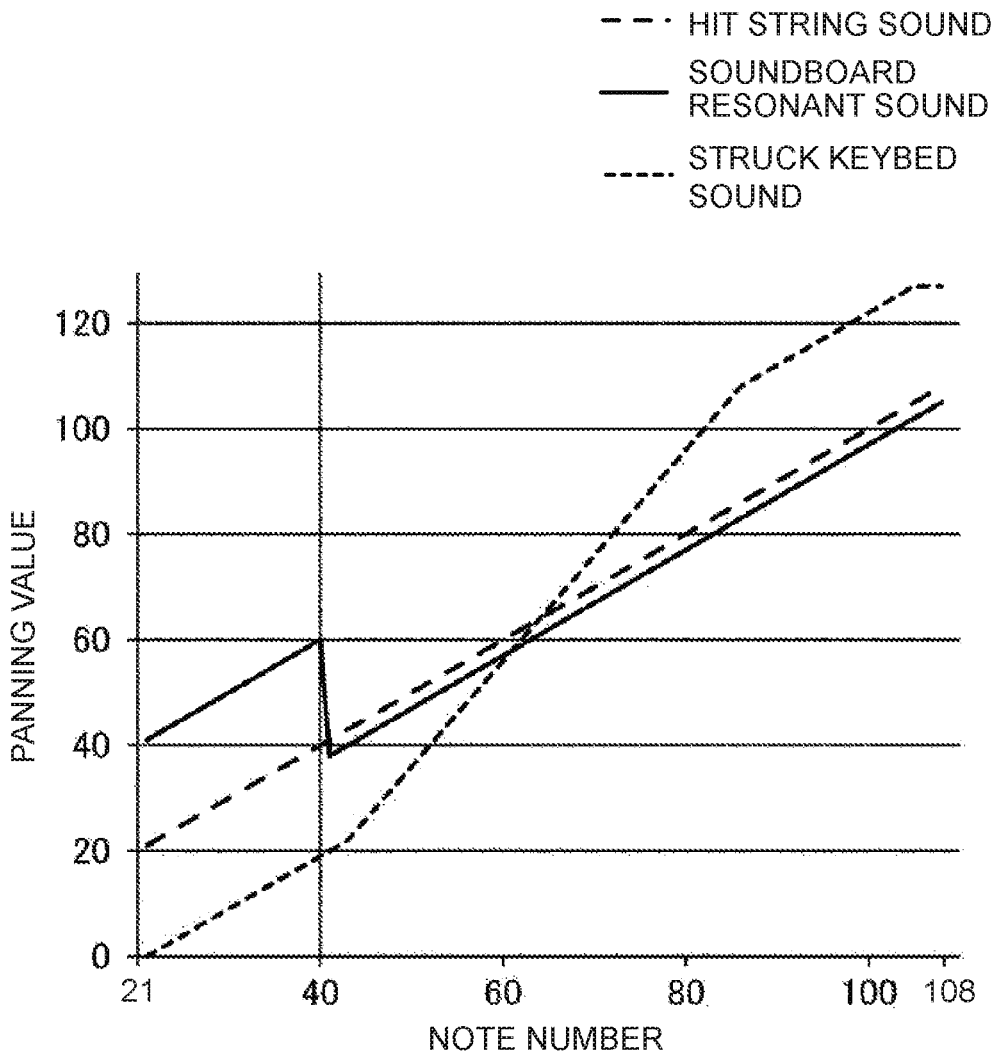
FIG. 4 is a diagram that depicts values of a panning Table as a graph.

Table 1 illustrates an example of a panning Table in which hit string sounds, soundboard resonant sounds, and struck keybed sounds, and panning values are associated with each other. FIG. 4 is a diagram in which the values in the panning Table are depicted as a graph.

TABLE 1

| | Pannning value [MIDI value] | | |
|---|---|---|---|
| Note Number [MIDI value] | Hit string sound | Soundboard resonant sound | Struck keybed sound |
| 21 | 21 | 41 | 0 |
| 22 | 22 | 42 | 1 |
| 23 | 23 | 43 | 2 |
| 24 | 24 | 44 | 3 |
| 25 | 25 | 45 | 4 |

TABLE 1-continued

| Note Number [MIDI value] | Pannning value [MIDI value] Hit string sound | Soundboard resonant sound | Struck keybed sound |
|---|---|---|---|
| 26 | 26 | 46 | 5 |
| 27 | 27 | 47 | 6 |
| 28 | 28 | 48 | 7 |
| 29 | 29 | 49 | 8 |
| 30 | 30 | 50 | 9 |
| 31 | 31 | 51 | 10 |
| 32 | 32 | 52 | 11 |
| 33 | 33 | 53 | 12 |
| 34 | 34 | 54 | 13 |
| 35 | 35 | 55 | 14 |
| 36 | 36 | 56 | 15 |
| 37 | 37 | 57 | 16 |
| 38 | 38 | 58 | 17 |
| 39 | 39 | 59 | 18 |
| 40 (E1) | 40 | 60 | 19 |
| 41 (F1) | 41 | 38 | 20 |
| 42 | 42 | 39 | 21 |
| 43 | 43 | 40 | 22 |
| 44 | 44 | 41 | 24 |
| 45 | 45 | 42 | 26 |
| 46 | 46 | 43 | 28 |
| 47 | 47 | 44 | 30 |
| 48 | 48 | 45 | 32 |
| 49 | 49 | 46 | 34 |
| 50 | 50 | 47 | 36 |
| 51 | 51 | 48 | 38 |
| 52 | 52 | 49 | 40 |
| 53 | 53 | 50 | 42 |
| 54 | 54 | 51 | 44 |
| 55 | 55 | 52 | 46 |
| 56 | 56 | 53 | 48 |
| 57 | 57 | 54 | 50 |
| 58 | 58 | 55 | 52 |
| 59 | 59 | 56 | 54 |
| 60 | 60 | 57 | 56 |
| 61 | 61 | 58 | 58 |
| 62 | 62 | 59 | 60 |
| 63 | 63 | 60 | 62 |
| 64 | 64 | 61 | 64 |
| 65 | 65 | 62 | 66 |
| 66 | 66 | 63 | 68 |
| 67 | 67 | 64 | 70 |
| 68 | 68 | 65 | 72 |
| 69 | 69 | 66 | 74 |
| 70 | 70 | 67 | 76 |
| 71 | 71 | 68 | 78 |
| 72 | 72 | 69 | 80 |
| 73 | 73 | 70 | 82 |
| 74 | 74 | 71 | 84 |
| 75 | 75 | 72 | 86 |
| 76 | 76 | 73 | 88 |
| 77 | 77 | 74 | 90 |
| 78 | 78 | 75 | 92 |
| 79 | 79 | 76 | 94 |
| 80 | 80 | 77 | 96 |
| 81 | 81 | 78 | 98 |
| 82 | 82 | 79 | 100 |
| 83 | 83 | 80 | 102 |
| 84 | 84 | 81 | 104 |
| 85 | 85 | 82 | 106 |
| 86 | 86 | 83 | 108 |
| 87 | 87 | 84 | 109 |
| 88 | 88 | 85 | 110 |
| 89 | 89 | 86 | 111 |
| 90 | 90 | 87 | 112 |
| 91 | 91 | 88 | 113 |
| 92 | 92 | 89 | 114 |
| 93 | 93 | 90 | 115 |
| 94 | 94 | 91 | 116 |
| 95 | 95 | 92 | 117 |
| 96 | 96 | 93 | 118 |
| 97 | 97 | 94 | 119 |
| 98 | 98 | 95 | 120 |
| 99 | 99 | 96 | 121 |
| 100 | 100 | 97 | 122 |

TABLE 1-continued

| Note Number [MIDI value] | Pannning value [MIDI value] Hit string sound | Soundboard resonant sound | Struck keybed sound |
|---|---|---|---|
| 101 | 101 | 98 | 123 |
| 102 | 102 | 99 | 124 |
| 103 | 103 | 100 | 125 |
| 104 | 104 | 101 | 126 |
| 105 | 105 | 102 | 127 |
| 106 | 106 | 103 | 127 |
| 107 | 107 | 104 | 127 |
| 108 | 108 | 105 | 127 |

In this embodiment, the sound source LSI 27 obtains the panning values of the hit string sound waveform data, the soundboard resonant sound waveform data, and the struck keybed sound waveform data on the basis of a panning Table as illustrated in Table 1. Hereafter, panning will be described in detail while referring to Table 1 and FIG. 4.

(a) Hit String Sound

The panning value of the hit string sound waveform data increases linearly as the note number increases, in other words, as the pitch of the key that is pressed becomes higher. This reproduces the manner in which the position at which a hit string sound is produced moves to the right as the pitch becomes higher from the viewpoint of the performer.

(b) Struck Keybed Sound

The panning value of the struck keybed sound waveform data also increases as the note number increases, that is, as the pitch of the key that is pressed becomes higher. This reproduces the manner in which the position at which a struck keybed sound is produced moves to the right as the pitch becomes higher from the viewpoint of the performer.

The panning values of the struck keybed sound waveform data change over a wider range than the panning values of the hit string sounds. This reproduces the manner in which the performer experiences a change in the position where a struck keybed sound is produced more clearly than a change in the position where a hit string sound is produced due to the position of the pressed key being closer to the performer than the position where the string is hit in an acoustic piano. In addition, the panning values of the struck keybed sound waveform data are not limited to those in the example illustrated in Table 1 and FIG. 4, and may instead be set to the same values as the panning values of the hit string sound waveform data.

(c) Sound Board Resonant Sound

The panning value of the soundboard resonant sound waveform data linearly increases as the note number increases in a range of note numbers lower than or equal to the note number 40 (corresponding to the pitch E1) and in a range of note numbers higher than or equal to the note number 41 (corresponding to the pitch F1). This reproduces the manner in which the position at which the soundboard resonant sound is produced from the viewpoint of the performer moves toward the front-right from the back-left along the short bridge 14S or the long bridge 14L as the pitch becomes higher in the acoustic piano 10 illustrated in FIG. 1, for example. Please note that note numbers 21-40 correspond to a sound range in which the soundboard 11 is made to resonate via the short bridge 14S and note numbers 41-108 correspond to a sound range in which the soundboard 11 is made to resonate via the long bridge 14L in the acoustic piano 10.

Furthermore, when the note number increases from 40 to 41, the panning value of the soundboard resonant sound waveform data decreases by more than 20. This reproduces the manner in which the position where the soundboard resonant sound is produced switches from the right end of the short bridge 14S to the left end of the long bridge 14L in the acoustic piano 10 exemplified in FIG. 1.

Hereafter, the relationship between the keyboard 21 and the panning values will be described on the basis of the relationship between the note numbers and the panning values. As described above, suppose that a first key in the keyboard 21 is one arbitrary key that corresponds to a note number lower than the note number 40, the second key is a key that corresponds to the note number 40, and that the third key is a key that corresponds to the note number 41. Then, according to Table 1, the panning value of the soundboard resonant sound waveform data corresponding to the second key is set so as to be larger than the panning values of the soundboard resonant sound waveform data corresponding to the first key and the third key. In addition, the panning value of the hit string sound waveform data corresponding to the second key is set so as to larger than the panning value of the hit string sound waveform data corresponding to the first key, and is set so as to be smaller than the panning value of the hit string sound waveform data corresponding to the third key. Furthermore, the panning value of the struck keybed sound waveform data corresponding to the second key is set so as to be larger than the panning value of the struck keybed sound waveform data corresponding to the first key, and is set so as to be smaller than the panning value of the struck keybed sound waveform data corresponding to the third key.

In addition, in this example of Table 1, the panning value of the soundboard resonant sound waveform data that corresponds to the note number 41 is smaller than the panning value of the soundboard resonant sound waveform data that corresponds to the note number 21. This reproduces the manner in which the position of the bridge at the left end of the long bridge 14L as seen from the viewpoint of the performer is located further to the left than the position of the bridge at the left end of the short bridge 14S in the acoustic piano 10 exemplified in FIG. 1.

The panning values of the hit string sound waveform data, the soundboard resonant sound waveform data, and the struck keybed sound waveform data are not limited to those in the example illustrated in Table 1 and FIG. 4, and may be changed as desired in accordance with the bridge arrangement and acoustic characteristics of the acoustic piano that is to be reproduced.

(2) Operation

Next, operation of the electronic musical instrument 20 will be described while referring to FIGS. 5 and 6. Hereafter, CPU processing executed by the CPU 24 is described, and then sound source processing executed by the sound source LSI 27 is described.

<CPU Processing>

Figure 5:
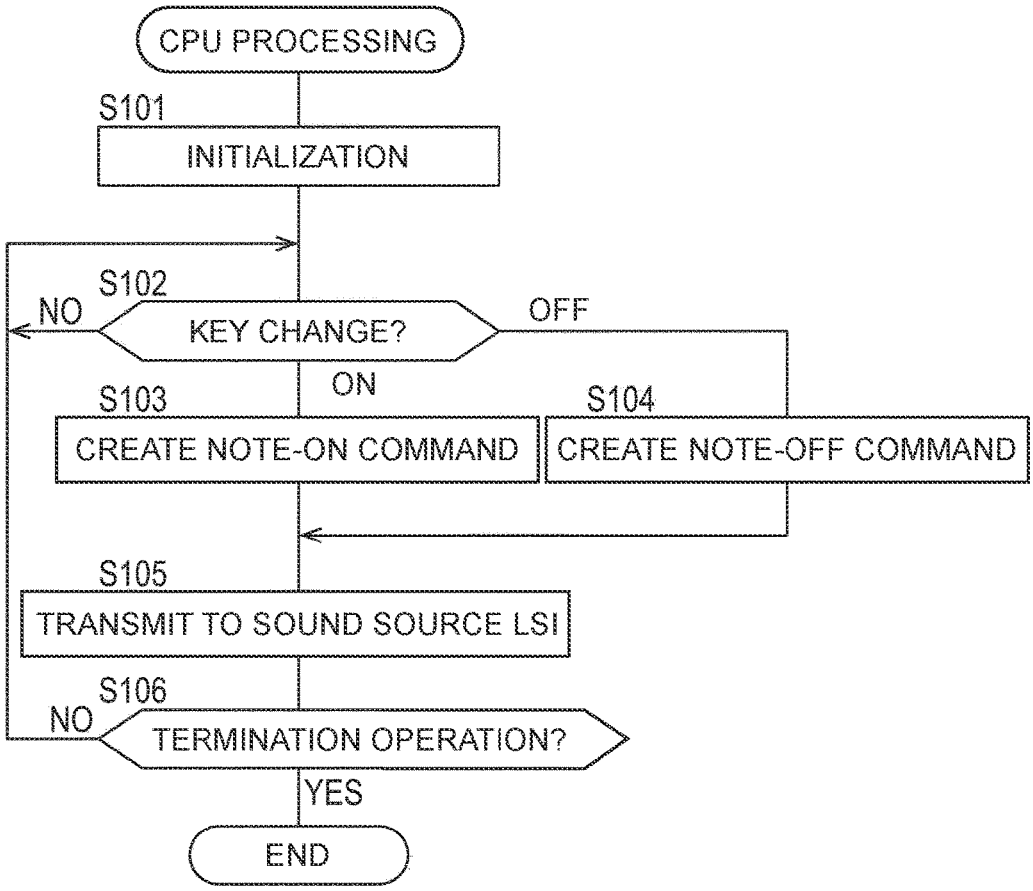
FIG. 5 is a flowchart illustrating a CPU processing procedure.

FIG. 5 is a flowchart illustrating a CPU processing procedure. The algorithm illustrated in the flowchart of FIG. 5 is stored as a program in the ROM 25 for example, and is executed by the CPU 24.

As illustrated in FIG. 5, when power supply to the electronic musical instrument 20 is initiated by operating the power switch included in the switch group 22 for example, the CPU 24 begins an initialization operation in which each part of the electronic musical instrument 20 is initialized (step S101). Once the CPU 24 has completed the initialization operation, the CPU 24 begins a change detection operation for each key in the keyboard 21 (step S102).

The CPU 24 stands while there is no key change (step S102: NO) until detecting a key change. On the other hand, when there is a key change, the CPU 24 determines whether a key-on event or a key-off event has occurred. In the case where a key-on event has occurred (step S102: ON), the CPU 24 creates a note-on command that includes information consisting of a note number and a velocity value (step S103). In the case where a key-off event has occurred (step S102: OFF), the CPU 24 creates a note-off command that includes information consisting of a note number and a velocity value (step S104). In this case, "velocity value", for example, is a value that is calculated on the basis of a difference in detection time between at least two contacts that are included in the key and that detect pressing of the key, and is a value that becomes larger as the detection time difference becomes smaller.

Once the CPU 24 has created the note-on command or note-off command, the CPU 24 transmits the created command to the sound source LSI 27 (step S105). The CPU 24 repeats the processing of steps S102 to S106 while a termination operation is not performed (step S106: NO) through operation of the power switch included in the switch group 22, for example. Once a termination operation has been performed (step S106: YES), the CPU 24 terminates the processing.

<Sound Source Processing>

Figure 6:
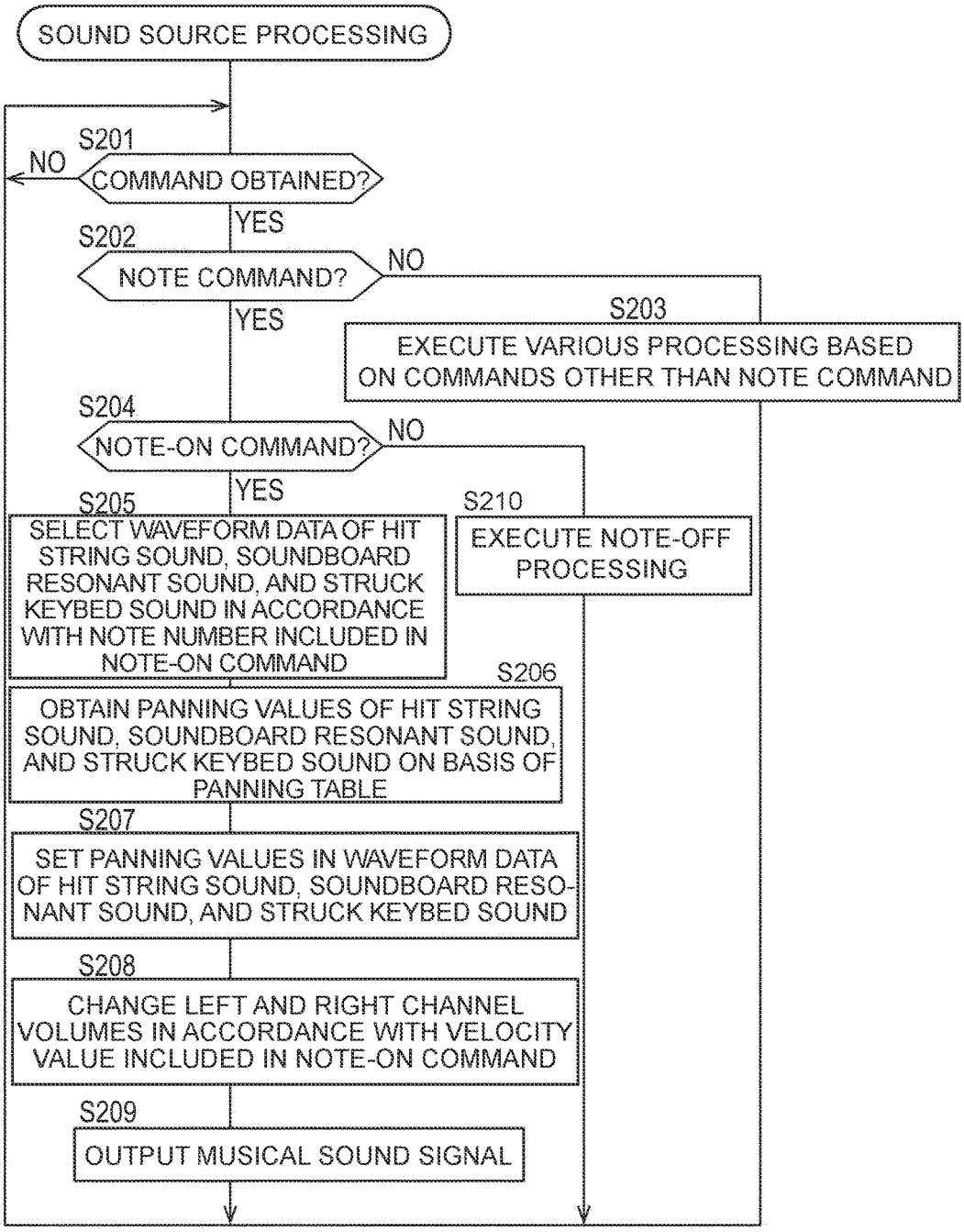
FIG. 6 is a flowchart illustrating a sound source processing procedure.

FIG. 6 is a flowchart illustrating a sound source processing procedure. The algorithm illustrated in the flowchart of FIG. 6 is stored as a program in the ROM 25 for example, and is executed by the sound source LSI 27.

As illustrated in FIG. 6, the sound source LSI 27 stands by while a command is not obtained from the CPU 24 (step S201: NO), until obtaining a command. Then, upon obtaining a command (step S201: YES), the sound source LSI 27 determines whether the obtained command is a note command (step S202). The sound source LSI 27 may obtain the command by receiving the command directly from the CPU 24, or may obtain the command via a shared buffer, for example.

In the case where the command is not a note command (step S202: NO), the sound source LSI 27 executes various processing based on commands other than a note command (step S203). After that, the sound source LSI 27 returns to the processing of step S201.

In the case where the command is a note command (step S202: YES), the sound source LSI 27 determines whether the obtained command is a note-on command (step S204).

In the case where the command is a note-on command (step S204: YES), the sound source LSI 27 selects hit string sound waveform data, soundboard resonant sound waveform data, and struck keybed sound waveform data in accordance with the note number included in the note-on command (step S205). Then, the sound source LSI 27 obtains the respective panning values for the hit string sound, the soundboard resonant sound, and the struck keybed sound corresponding to the note number on the basis of the panning Table stored in the ROM 25 (step S206).

Next, the sound source LSI 27 sets the panning values obtained in step S206 in the hit string sound waveform data, soundboard resonant sound waveform data, and struck keybed sound waveform data selected in step S205 (step S207) to set the left-right channel balance of the respective sound components. Then, the sound source LSI 27 determines the volume of each of the left and right channels for the hit string sound waveform data, soundboard resonant sound waveform data, and struck keybed sound waveform data in accordance with the velocity value included in the note-on command together with the respective panning values that set forth the left-right balance (step S208).

Subsequently, the sound source LSI 27 outputs a digital musical sound signal based on the hit string sound waveform data, soundboard resonant sound waveform data, and struck keybed sound waveform data for which the volumes were changed in step S208 (step S209). As described above, the output digital musical sound signal is subjected to analog conversion and so forth by the sound-producing system 28, and is output as musical sound from the left-channel side and the right-channel side of the sound-producing system 28.

On the other hand, in the case where the command obtained in step S201 is not a note-on command (step S204: NO), that is, in the case where the command is a note-off command, the sound source LSI 27 executes note-off processing (step S210). After that, the sound source LSI 27 returns to the processing of step S201.

As described above, the electronic musical instrument 20 of this embodiment is equipped with a keyboard that includes at least a first key, a second key that corresponds to a pitch that is higher than a pitch that corresponds to the first key, and a third key that corresponds to a pitch that is higher than the pitch that corresponds to the second key. The panning value of the soundboard resonant sound waveform data corresponding to the second key is set so as to be larger than the panning values of the soundboard resonant sound waveform data corresponding to the first key and the third key. As a result, the electronic musical instrument 20 can simulate changes that occur in the positions where soundboard resonant sounds are produced, and can reproduce the manner in which an acoustic piano produces sound.

Furthermore, the third key is adjacent to the right side of the second key in the electronic musical instrument 20. Thus, despite the keys being located at adjacent positions, the electronic musical instrument 20 is able to accurately reproduce the manner in which the positions where soundboard resonant sounds are produced differ greatly from each other.

In addition, the electronic musical instrument 20 sets the panning value of the hit string sound waveform data corresponding to the second key so as to larger than the panning value of the hit string sound waveform data corresponding to the first key, and so as to be smaller than the panning value of the hit string sound waveform data corresponding to the third key. The electronic musical instrument 20 is able to separately set the panning values of hit string sound waveform data to different values from those for the soundboard resonant sound waveform data, and can also faithfully reproduce changes in the positions where the hit string sounds are produced.

Furthermore, the electronic musical instrument 20 sets the panning value of the struck keybed sound waveform data corresponding to the second key so as to be larger than the panning value of the struck keybed sound waveform data corresponding to the first key, and so as to be smaller than the panning value of the struck keybed sound waveform data corresponding to the third key. The electronic musical instrument 20 is able to separately set appropriate panning values for the struck keybed sound waveform data as well, and can also faithfully reproduce changes in the positions where the struck keybed sounds are produced.

In addition, in the electronic musical instrument 20, the pitch corresponding to the second key is a pitch that corresponds to the bridge at the right end of the short bridge of the acoustic piano, and the pitch corresponding to the third key is a pitch that corresponds to the bridge at the left end of the long bridge of the acoustic piano. Therefore, the electronic musical instrument 20 can set the panning value for the second key on the basis of the arrangement of the bridge at the right end of the short bridge, can set the panning value for the third key on the basis of the arrangement of the bridge at the left end of the long bridge, and can output soundboard resonant sounds that reproduce the arrangements of the respective bridges.

In addition, the electronic musical instrument 20 sets the panning value of the soundboard resonant sound waveform data corresponding to the third key so as to be smaller than the panning value of the soundboard resonant sound waveform data corresponding to the key having the lowest pitch included in the keyboard. Thus, the electronic musical instrument 20 is able to reproduce the manner in which the position of the bridge at the left end of the long bridge as seen from the viewpoint of the performer is located further to the left than the position of the bridge at the left end of the short bridge in the acoustic piano, and is able to additionally faithfully reproduce the positions at which the soundboard resonant sounds are produced.

It is described in the above embodiment that the sound source LSI 27 stores three types of waveform data, namely, hit string sound waveform data, soundboard resonant sound waveform data, and struck keybed sound waveform data as the piano musical sound waveform data. However, this embodiment is not limited to this example, and the sound source LSI 27 may instead store only hit string sound waveform data and soundboard resonant sound waveform data as the piano musical sound waveform data. In other words, the electronic musical instrument 20 may instead output only hit string sounds and soundboard resonant sounds, which have been subjected to appropriate panning, as the musical sound of a piano. The processing load of the electronic musical instrument 20 can be reduced in this way.

Furthermore, it is described in the above embodiment that the left-channel side output proportion is large when the panning value is made small, and that the right-channel side output proportion is large when the panning value is made large. However, this embodiment is not limited to this example. The sound source LSI 27 may instead employ a scheme in which the relationship between the size of the panning value and the outputs of the left and right channels is reversed. In other words, the sound source LSI 27 may employ a scheme in which the right-channel side output proportion is large when the panning value is made small, and the left-channel side output proportion is large when the panning value is made large. In this case, the panning values of the hit string sound waveform data and the struck keybed sound waveform data decrease as the note number increases. The panning value of the soundboard resonant sound waveform data linearly decreases as the note number increases in a range of note numbers lower than or equal to the note number 40 and a range of note numbers higher than or equal to the note number 41, and increases by 20 or more when the note number increases from 40 to 41. Alternatively, the sound source LSI 27 may use the scheme in which the relationship between the size of the panning value and the outputs of the left and right channels is reversed only when setting any one of the hit string sound waveform data, the soundboard resonant sound waveform data, and the struck keybed sound waveform data.

In addition, it is described in the above embodiment that a key corresponding to the pitch E1 (note number 40) is the second key, and a key corresponding to the pitch F1 (note number 41) is the third key. However, this embodiment is not limited to this example. The second key and the third key do not have to be adjacent to each other, and another arbitrary key (keys) may be located between the second key and the third key.

In addition, the present invention is not limited to the above-described embodiment, and may be modified in various ways in the implementation phase within a scope that does not deviate from the gist of the present invention. Furthermore, the functions executed in the above-described embodiment may be appropriately combined with each other as much as possible. A variety of stages are included in the above-described embodiment, and a variety of inventions can be extracted by using appropriate combinations of a plurality of the disclosed constituent elements. For example, even if a number of constituent elements are removed from among all the constituent elements disclosed in the embodiment, the configuration obtained by removing these constituent elements can be extracted as an invention provided that an effect is obtained.

Thus, it is intended that the present invention cover modifications and variations that come within the scope of the appended claims and their equivalents.

What is claimed is:

1. An electronic musical instrument comprising:

a first key that is assigned a sound of a first pitch;

a second key that is arranged to the right of the first key, as viewed from a performer of the electronic musical instrument, the second key corresponding to an acoustic key associated with a right end of a short bridge in an acoustic piano and being assigned a sound of a second pitch that is higher than the first pitch;

a third key that is arranged to the right of the second key, as viewed from the performer of the electronic musical instrument, the third key corresponding to an acoustic key associated with a left end of a long bridge in the acoustic piano that is placed to the left of the right end of the short bridge, the third key being assigned a sound of a third pitch that is higher than the second pitch; and one or more processors that acquire panning values respectively assigned to the first key, the second key, and the third key, each panning value setting forth a left-right balance between a left-channel speaker and a right-channel speaker for the sound specified by each key, and the one or more processors generating, in response to an operation of one of the first, second and third keys, corresponding sound data for outputting from the left-channel speaker and the right-channel speaker in accordance with the assigned panning value, wherein the panning values respectively assigned to the second and third keys are set such that the left-right balance of the sound data of the third key is shifted towards the left speaker as compared with the left-right balance of the sound data of the second key.

2. The electronic musical instrument according to claim 1, wherein the sound data of each of the first through third keys includes soundboard resonant sound data that represents sound produced when a soundboard of an acoustic piano resonates, and wherein each of the panning values sets forth the left-right balance for the soundboard resonant sound data so that the left-right balance of the soundboard resonant sound data of the third key is shifted towards the left speaker as compared with the left-right balance of the soundboard resonant sound data of the second key.

3. The electronic musical instrument according to claim 1, further comprising:

a keyboard having a plurality of keys arranged from the left to the right, representing progressively higher pitches from the left to the right, the keyboard including said first, second and third keys, wherein panning values are respectively assigned to all of the plurality of keys, wherein the keyboard includes a first plurality of keys that are arranged consecutively from a key that is at the immediate right to the second key and that includes the third key, and wherein the panning value for each of the first plurality of keys is set such that the left-right balance of the sound data of each of the first plurality of keys is shifted towards the left speaker as compared with the left-right balance of the sound data of the second key.

4. The electronic musical instrument according to claim 2, wherein the sound data of each of the first through third keys further includes hit string sound data that represents a sound produced when a string of the acoustic piano is hit in addition to the soundboard resonant sound data, and wherein a separate set of panning values is provided to set forth a left-right balance for the hit string sound data for each of the first to third keys such that the left-right balance of the hit string sound data of the second key is shifted towards the right speaker as compared with the left-right balance of the hit string sound data of the first key and such that the left-right balance of the hit string sound data of the third key is shifted towards the right speaker as compared with the left-right balance of the hit string sound data of the second key.

5. The electronic musical instrument according to claim 2, wherein the sound data of each of the first through third keys further includes struck keybed sound data that represents sound produced when a keybed of the acoustic piano is struck in addition to the soundboard resonant sound data, and wherein a separate set of panning values is provided to set forth a left-right balance for the struck keybed sound data for each of the first to third keys such that the left-right balance of the struck keybed sound data of the second key is shifted towards the right speaker as compared with the left-right balance of the struck keybed sound data of the first key and such that the left-right balance of the struck keybed sound data of the third key is shifted towards the right speaker as compared with the left-right balance of the struck keybed sound data of the second key.

6. The electronic musical instrument according to claim 4, wherein the sound data of each of the first through third keys further includes struck keybed sound data that represents sound produced when a keybed of the acoustic piano is struck in addition to the soundboard resonant sound data and the hit string sound data, and wherein another separate set of panning values is provided to set forth a left-right balance for the struck keybed sound data for each of the first to third keys such that the left-right balance of the struck keybed sound data of the second key is shifted towards the right speaker as compared with the left-right balance of the struck keybed sound data of the first key and such that the left-right balance of the struck keybed sound data of the third key is shifted towards the right speaker as compared with the left-right balance of the struck keybed sound data of the second key.

7. The electronic musical instrument according to claim 1, further comprising:

a keyboard having a plurality of keys arranged from the left to the right, representing progressively higher pitches from the left to the right, the keyboard including said first, second and third keys, wherein panning values are respectively assigned to all of the plurality of keys, and wherein the sound data of each of the first through third keys includes soundboard resonant sound data that represents sound produced when a soundboard of an acoustic piano resonates, and wherein each of the panning values sets forth the left-right balance for the soundboard resonant sound data so that the left-right balance of the soundboard resonant sound data of the third key is shifted towards the left speaker as compared with the left-right balance of the soundboard resonant sound data of a leftmost key that is assigned to a lowest pitch sound.

8. The electronic musical instrument according to claim 1, further comprising:

a memory storing the panning values for the respective keys in the form of a table, wherein the one or more processor acquires the panning values by accessing the memory.

9. The electronic musical instrument according to claim 3, further comprising:

a memory storing the panning values for the respective keys in the form of a table, wherein the one or more processor acquires the panning values by accessing the memory.

10. A sound production control method performed by one or more processors in an electronic musical instrument that includes: a first key that is assigned a sound of a first pitch; a second key that is arranged to the right of the first key, as viewed from a performer of the electronic musical instrument, the second key corresponding to an acoustic key associated with a right end of a short bridge in an acoustic piano and being assigned a sound of a second pitch that is higher than the first pitch; a third key that is arranged to the right of the second key, as viewed from the performer of the electronic musical instrument, the third key corresponding to an acoustic key associated with a left end of a long bridge in the acoustic piano that is placed to the left of the right end of the short bridge, the third key being assigned a sound of a third pitch that is higher than the second pitch; and said processor, the method comprising:

acquiring panning values respectively assigned to the first key, the second key, and the third key, each panning value setting forth a left-right balance between a left-channel speaker and a right-channel speaker for the sound specified by each key; and in response to an operation of one of the first, second and third keys, generating corresponding sound data for outputting from the left-channel speaker and the right-channel speaker in accordance with the assigned panning value, wherein the panning values respectively assigned to the second and third keys are set such that the left-right balance of the sound data of the third key is shifted towards the left speaker as compared with the left-right balance of the sound data of the second key.

11. A non-transitory computer-readable storage medium having stored thereon a program executable by one or more processors in an electronic musical instrument that includes: a first key that is assigned a sound of a first pitch; a second key that is arranged to the right of the first key, as viewed from a performer of the electronic musical instrument, the second key corresponding to an acoustic key associated with a right end of a short bridge in an acoustic piano and being assigned a sound of a second pitch that is higher than the first pitch; a third key that is arranged to the right of the second key, as viewed from the performer of the electronic musical instrument, the third key corresponding to an acoustic key associated with a left end of a long bridge in the acoustic piano that is placed to the left of the right end of the short bridge, the third key being assigned a sound of a third pitch that is higher than the second pitch; and said processor, the program causing the one or more processors to perform the following:

acquiring panning values respectively assigned to the first key, the second key, and the third key, each panning value setting forth a left-right balance between a left-channel speaker and a right-channel speaker for the sound specified by each key; and in response to an operation of one of the first, second and third keys, generating corresponding sound data for outputting from the left-channel speaker and the right-channel speaker in accordance with the assigned panning value, wherein the panning values respectively assigned to the second and third keys are set such that the left-right balance of the sound data of the third key is shifted towards the left speaker as compared with the left-right balance of the sound data of the second key.

* * * * *